US007153215B2

(12) United States Patent
Peterson et al.

(10) Patent No.: US 7,153,215 B2
(45) Date of Patent: Dec. 26, 2006

(54) METHOD OF FITTING A GOLF CLUB TO A GOLFER

(75) Inventors: Randolph J. Peterson, Carlsbad, CA (US); Nicholas C. Arthur, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 11/160,065

(22) Filed: Jun. 7, 2005

(65) Prior Publication Data

US 2005/0277483 A1 Dec. 15, 2005

Related U.S. Application Data

(60) Provisional application No. 60/579,110, filed on Jun. 10, 2004.

(51) Int. Cl.
*A63B 53/00* (2006.01)

(52) U.S. Cl. ..... 473/199; 473/409

(58) Field of Classification Search ..... 473/409, 473/199

See application file for complete search history.

(56) References Cited

U.S. PATENT DOCUMENTS 4,063,259 A 12/1977 Lynch et al.
4,136,387 A 1/1979 Sullivan et al.
4,137,566 A 1/1979 Haas et al.
4,158,853 A 6/1979 Sullivan et al.
4,160,942 A 7/1979 Lynch et al.
5,421,098 A * 6/1995 Muldoon ..... 33/508
5,471,383 A 11/1995 Gobush et al.
5,947,840 A * 9/1999 Ryan ..... 473/335
6,086,487 A 7/2000 Morgan et al.
6,192,323 B1 2/2001 Boehm
6,385,559 B1 5/2002 Boehm
6,431,990 B1 8/2002 Manwaring
6,490,542 B1 12/2002 Boehm
6,558,278 B1 * 5/2003 Bunn et al. ..... 473/409
6,565,448 B1 5/2003 Cameron et al.
6,611,792 B1 8/2003 Boehm
6,638,175 B1 10/2003 Lee et al.
6,648,769 B1 11/2003 Lee et al.
6,658,371 B1 12/2003 Boehm et al.
6,739,983 B1 5/2004 Helmstetter et al.
6,821,209 B1 11/2004 Manwaring et al.
2002/0119828 A1 * 8/2002 Toulon et al. ..... 473/287
2002/0155896 A1 * 10/2002 Gobush et al. ..... 473/197
2003/0008731 A1 1/2003 Anderson et al.
2003/0119595 A1 * 6/2003 Manwaring et al. ..... 473/198
2003/0148818 A1 * 8/2003 Myrhum et al. ..... 473/290
2004/0006442 A1 1/2004 Boehm
2004/0204262 A1 * 10/2004 White et al. ..... 473/287

FOREIGN PATENT DOCUMENTS

JP 5-7637 * 1/1993

* cited by examiner

*Primary Examiner*—Stephen Blau
(74) *Attorney, Agent, or Firm*—Michael A. Catania; Elaine H. Lo

(57) ABSTRACT

A method a fitting a golf club to a golfer based on the golfer's playing characteristics and the inherent properties of the golfer's current golf club. A golf club is selected and a analyzed to determine if the selected golf club is optimized for the golfer.

8 Claims, 7 Drawing Sheets

| | 1 | 2 | 3 | 4 | 5 | 6 | 7 | 8 | 9 | 10 |
|---|---|---|---|---|---|---|---|---|---|---|
| 1 | A1 | LD | LS | LF | SD | SS | SF | RD | RS | RF |
| 2 | HN | L2 | L3 | M4 | M3 | M3 | M4 | M3 | M4 | M4 |
| 3 | HS | H2 | H3 | H4 | H3 | H3 | H4 | H3 | H4 | H4 |
| 4 | HA | H2 | H3 | H4 | H3 | H3 | H4 | H3 | H4 | H4 |
| 5 | MN | L2 | L3 | L4 | L3 | L3 | L4 | L3 | L4 | L4 |
| 6 | MS | M2 | M3 | M4 | M3 | M3 | M4 | M3 | M4 | M4 |
| 7 | MA | H2 | H3 | H4 | H3 | H3 | H4 | H3 | H4 | H4 |
| 8 | LN | L2 | L3 | L4 | L3 | L3 | L4 | L3 | L4 | L4 |
| 9 | LS | L2 | L3 | L4 | L3 | L3 | L4 | L3 | L4 | L4 |
| 10 | LA | M2 | M3 | M4 | M3 | M3 | M4 | M3 | M4 | M4 |

80

| | 1 | 2 | 3 | 4 | 5 | 6 | 7 | 8 | 9 | 10 |
|---|---|---|---|---|---|---|---|---|---|---|
| 1 | A1 | LD | LS | LF | SD | SS | SF | RD | RS | RF |
| 2 | HN | L2 | L3 | M4 | M3 | M3 | M4 | M3 | M4 | M4 |
| 3 | HS | H2 | H3 | H4 | H3 | H3 | H4 | H3 | H4 | H4 |
| 4 | HA | H2 | H3 | H4 | H3 | H3 | H4 | H3 | H4 | H4 |
| 5 | MN | L2 | L3 | L4 | L3 | L3 | L4 | L3 | L4 | L4 |
| 6 | MS | M2 | M3 | M4 | M3 | M3 | M4 | M3 | M4 | M4 |
| 7 | MA | H2 | H3 | H4 | H3 | H3 | H4 | H3 | H4 | H4 |
| 8 | LN | L2 | L3 | L4 | L3 | L3 | L4 | L3 | L4 | L4 |
| 9 | LS | L2 | L3 | L4 | L3 | L3 | L4 | L3 | L4 | L4 |
| 10 | LA | M2 | M3 | M4 | M3 | M3 | M4 | M3 | M4 | M4 |

*FIG. 3*

| Ball Speed | Launch Angle | Backspin | Side Angle | Sidespin | True Spin |
|---|---|---|---|---|---|
| 80 | 12°- 15° | 3500 | 3° | 500 | 3000-4000 |
| 90 | 12°- 15° | 3400 | 3° | 500 | 2900-3900 |
| 100 | 11°- 14° | 3300 | 3° | 500 | 2800-3800 |
| 110 | 11°- 14° | 3200 | 3° | 500 | 2700-3700 |
| 120 | 10°- 13° | 3100 | 3° | 500 | 2600-3600 |
| 130 | 10°- 13° | 3000 | 3° | 500 | 2500-3500 |
| 140 | 10°- 13° | 2900 | 3° | 500 | 2400-3400 |
| 150 | 9°- 12° | 2800 | 3° | 500 | 2300-3300 |
| 160 | 9°- 12° | 2700 | 3° | 500 | 2200-3200 |
| 170 | 8°- 11° | 2600 | 3° | 500 | 2100-3100 |
| 180 | 8°- 11° | 2500 | 3° | 500 | 2000-3000 |

*FIG. 7*

METHOD OF FITTING A GOLF CLUB TO A GOLFER

CROSS REFERENCES TO RELATED APPLICATIONS

This Application claims priority to U.S. Provisional Patent Application No. 60/579,110 which was filed on Jun. 10, 2004.

BACKGROUND OF THE INVENTION

1. Field of the Invention

The present invention relates to a method for fitting a golf club to a golfer.

2. Description of the Related Art

U.S. Pat. No. 6,702,692 for a Precise Fit Golf Club Fitting System And Golf Shaft Selection Method And Apparatus.

U.S. patent application Ser. No. 10/188,669 for an Automated Method And System For Golf Club Selection Based On Swing Type.

U.S. Pat. No. 6,719,648 for a Precise Fit Golf Club Fitting System And Golf Shaft Selection Method And Apparatus.

U.S. Pat. No. 6,083,123 for Method For Fitting Golf Clubs For Golfers.

U.S. patent application Ser. No. 10/602,075 for a Method For Matching Golfers With A Driver And Ball.

BRIEF SUMMARY OF THE INVENTION

The present invention is a method for fitting a golf club for a golfer based on the golfer's ball striking characteristics. The method generally involves inputting information on the golfer's playing characteristics and the inherent properties of the golfer's current golf club into a fitting algorithm. The fitting algorithm will allow a fitting technician to select a golf club that is appropriate for the golfer based on the inputted information. The golfer then hits several golf balls with the golf club. A launch monitor will analyze the golfer's ball striking characteristics to determine if the selected golf club is appropriate for the golfer. Face tape placed on the face of the golf club will provide information on the ball impact location for the golfer. The technician will correlate the ball impact locations with the center of gravity location of the selected golf club head to determine if a golf club head with that center of gravity location is appropriate for the golfer. The ball striking characteristics of the golfer are compared with a predetermined optimized range based on a golfer's swing speed. If the golfer's ball striking characteristics are within the optimized range and the center of gravity location is appropriate for the golfer, then the selected golf club is appropriate for the golfer and the fitting is finished. However, if the golfer's ball striking characteristics are not within the optimized range or the center of gravity location is not appropriate for the golfer, then a second golf club is selected for the golfer and the analysis is repeated until an appropriate golf club is selected for the golfer.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 3 is a matrix for the fitting alogorithm.

FIG. 7 is a table of ball parameters for typical club speeds.

DETAILED DESCRIPTION OF THE INVENTION

Figure 1:
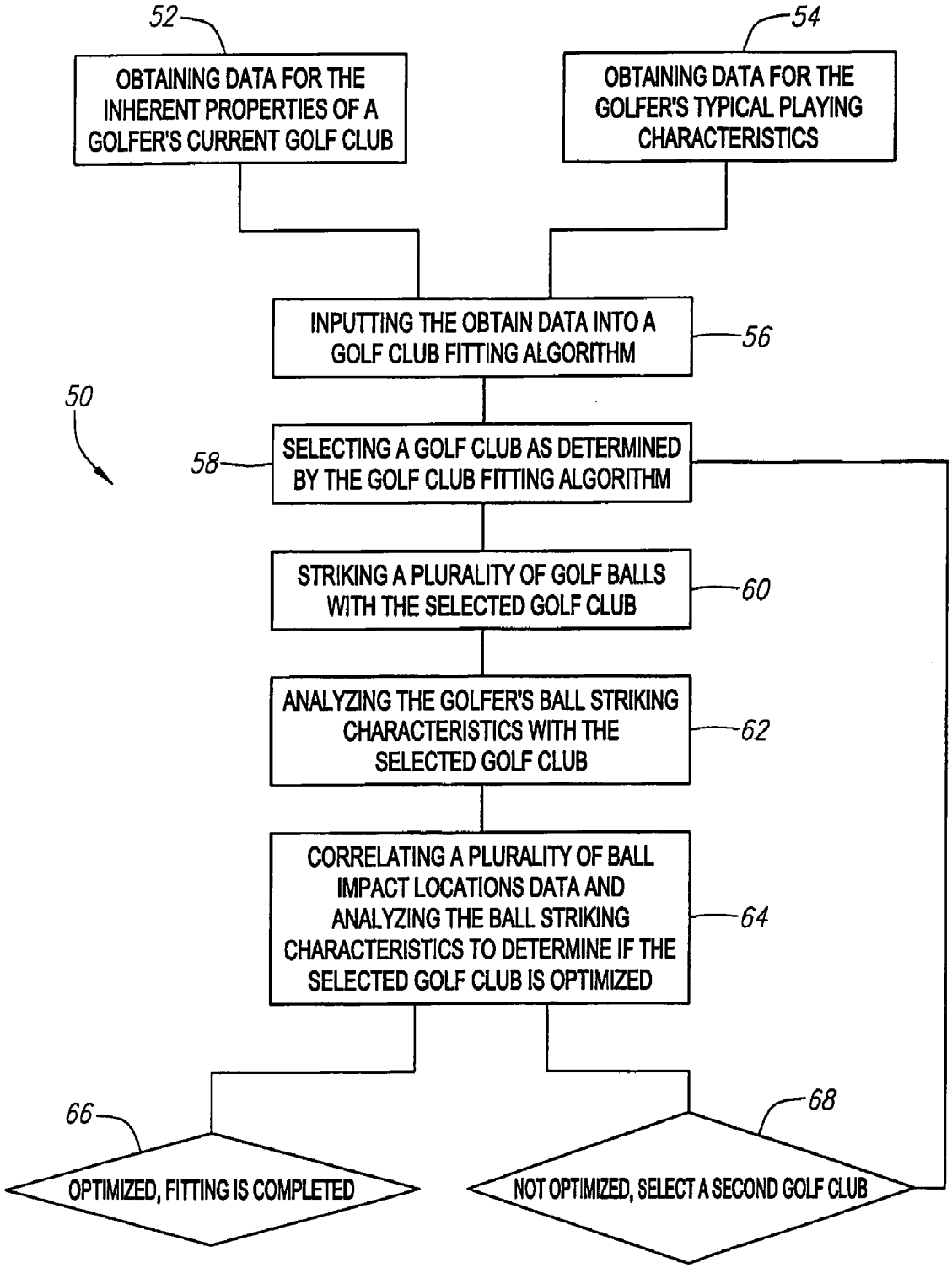
FIG. 1 is a flow chart of a preferred method of the present invention.
Figure 2:
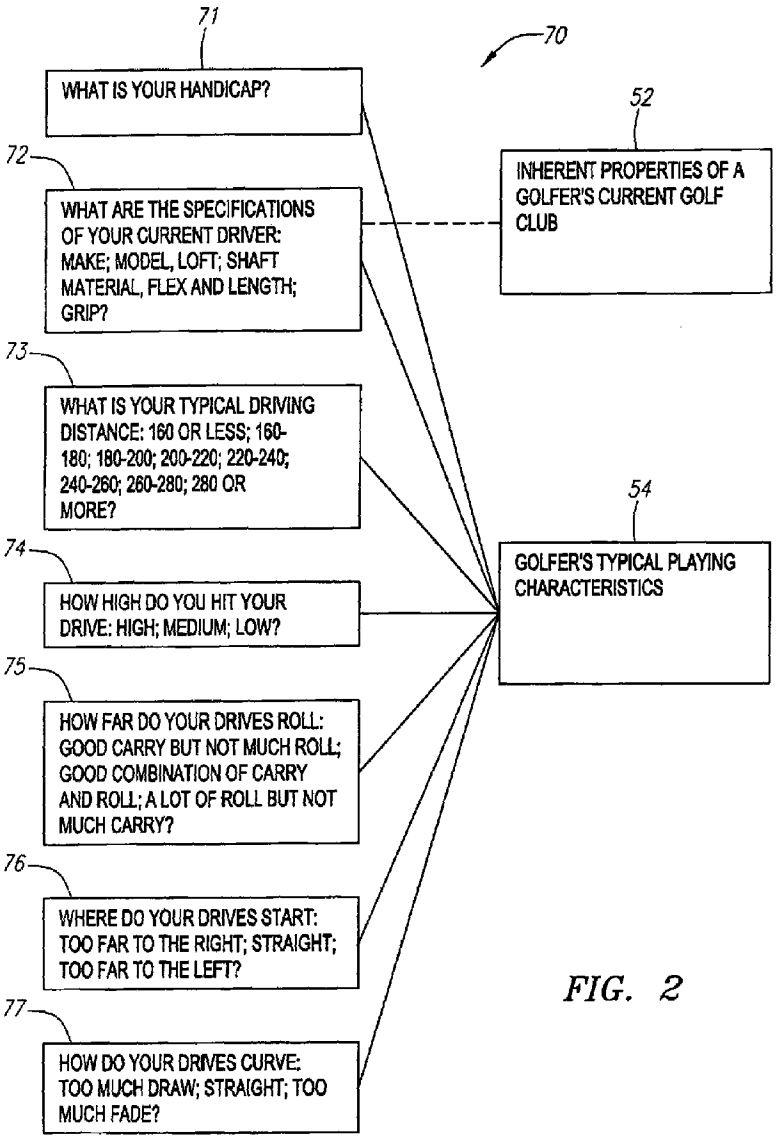
FIG. 2 is an illustration of a questionnaire for the golfer's typical playing characteristics.

The general method of the present invention is generally illustrated in FIG. 1. The method 50 begins at block 52 by obtaining information for the inherent properties of a golfer's current golf club. Inquiries to obtain such information are illustrated in FIG.2 and discussed in greater detail below. Next, at block 54, information is obtained on a golfer's typical playing characteristics. Next, at block 56, the data for the inherent properties of a golfer's current golf club and the data for the golfer's typical playing characteristics are inputted into a golf club fitting algorithm, which is shown in FIG. 3 and discussed in greater detail below. At block 58, a golf club is selected for the golfer based on fitting algorithm. Next, at block 60, the golfer hits a plurality of golf balls with the selected golf club. Preferably, the golfer hits between six and ten golf balls. Next, the golfer's ball striking characteristics are analyzed for the selected golf club using a monitoring system such as disclosed in U.S. Pat. No. 6,431,990 for a System And Method For Measuring A Golfer's Ball Striking Parameters, which is hereby incorporated by reference in its entirety. Next, at block 64, data for a plurality of ball impact locations are correlated with the center of gravity location of the selected golf club and the golfer's analyzed ball striking characteristics are used to determine if the selected golf club is optimized for the golfer. If the golf club is optimized for the golfer, then at decision 66, the fitting is complete. If the selected golf club is not optimized for the golfer, then at decision 68, a second golf club is selected for the golfer and steps 60–64 are repeated for the second selected golf club until an optimized golf club is selected for the golfer.

A general questionnaire 70 for obtaining a golfer's typical playing characteristics is illustrated in FIG. 2. At block 71, the golfer is asked about his/her handicap. At block 72, the golfer is asked about the specifications for the golfer's current golf club. This information is also used for block 52 of the general method 50. At block 73, the golfer is asked about the golfer's typical driving distance, and more specifically asked to choose a range: 160 yards or less; 160 yards to 180 yards; 180 yards to 200 yards; 200 yards to 220 yards; 220 yards–240 yards; 240 yards–260 yards; 260 yards–280 yards; or, 280 yards or more. At block 74, the golfer is asked how high the golfer hits the golfer's drive: high, medium, or low. At block 75 the golfer is asked how far the golfer's drives rolls. The golfer is asked to choose from the following: good carry but not much roll; good combination of carry and roll; and, a lot of roll but not much carry. At block 76, the golfer is asked where the golfer's drives starts. The golfer is asked to choose from the following: too far to the right; straight; and, too far to the left. At block 77, the golfer is asked to describe the curve of the golfer's typical drives. The golfer is asked to choose from the following: too much draw; straight; and, too much fade.

Additional information for a golfer's current golf club may be provided by the manufacturer of the current golf club, or other readily available sources. Further, if the golfer has the golfer's current golf club, non-destructive tests may be conducted to determine some of the inherent properties of the golfer's current golf club. The inherent properties obtained for the golfer's current golf club include the following: make, model, loft angle, shaft material composition, shaft length, shaft flex, mass of the golf club, grip material, golf club head volume, and center of gravity position of the golf club.

The data for the golfer's typical playing characteristics and inherent properties of the golfer's current golf club are inputted into a fitting algorithm to determine an appropriate golf club for the golfer. The fitting algorithm is based on a matrix such as illustrated in FIG. 3.

The first row is related to the combination of two inquiries: where does the golfer's drive usually start and where does the golfer's drive usually curve. LD represents a start left and then a draw. LS represents a start left and then straight. LF represents a start left and then a fade. SD represents a start straight and then a draw. SS represents a start straight and then continuation straight. SF represents a start straight and then a fade. RD represents a start right and then a draw. RS represents a start right and then straight. RF represents a start right and then a fade.

The first column is related to the combination of two inquiries: how high is the golfer's typical drive and what is the type of roll from the golfer's typical drive. HN represents a high hit and good carry but not much roll. HS represents a high hit and a good combination of carry and roll. HA represents a high hit and a good roll but not much carry. MN represents a medium hit and good carry but not much roll. MS represents a medium hit and a good combination of carry and roll. MA represents a medium hit and a good roll but not much carry. LN represents a low hit and good carry but not much roll. LS represents a low hit and a good combination of carry and roll. LA represents a low hit and a good roll but not much carry.

The selected golf club for the golfer is determined by the matrix. The alpha-numeric codes within the boxes represent the center of gravity positions for golf club heads. "H" represents a vertically (sole to crown) high center of gravity, "M" represents a vertically medium center of gravity, and "L" represents a vertically low center of gravity. "2" represents a horizontally (toe to heel) neutral-bias center of gravity, "3" represents a draw bias (towards the heel) center of gravity, and "4" represents a very draw bias (towards the heel) center of gravity. For example, "H2" is a high-neutral center of gravity. "M4" is a medium very draw bias center of gravity. Golf clubs heads with variations in the center of gravity are disclosed in U.S. Pat. No. 6,739,983 for a Golf Club Head With Customizable Center of Gravity, which is hereby incorporated by reference in its entirety.

If a box for the golfer is within columns 2–3 and rows 6–10, then the selected golf club should have a lower loft angle, preferably one loft angle lower. For example, if the golfer's current golf club has a eleven degrees loft, then the selected golf club should have a ten degrees loft. If a box for the golfer is within columns 8–10 and rows 6–10, then the selected golf club should have a higher loft angle, preferably one loft angle higher. For example, if the golfer's current golf club has a nine degrees loft, then the selected golf club should have a ten degrees loft. If a box for the golfer is within columns 4–7 and rows 6–10, the loft angle is acceptable. If a box for the golfer is within columns 2–3 and rows 2–5, then the selected golf club should have a lower loft angle, preferably one and half loft angles lower. For example, if the golfer's current golf club has a eleven degrees loft, then the selected golf club should have a nine and a half (9.5) degrees loft. If a box for the golfer is within columns 4–7 and rows 2–5, then the selected golf club should have a half-loft angle adjustment, preferably a half loft angle higher. For example, if the golfer's current golf club has a nine degrees loft, then the selected golf club should have a nine and a half (9.5) degrees loft. If a box for the golfer is within columns 8–10 and rows 2–5, then the selected golf club should have a higher loft angle, preferably one and half loft angles higher. For example, if the golfer's current golf club has a ten degrees loft, then the selected golf club should have an eleven and a half (11.5) degrees loft.

Figure 4:
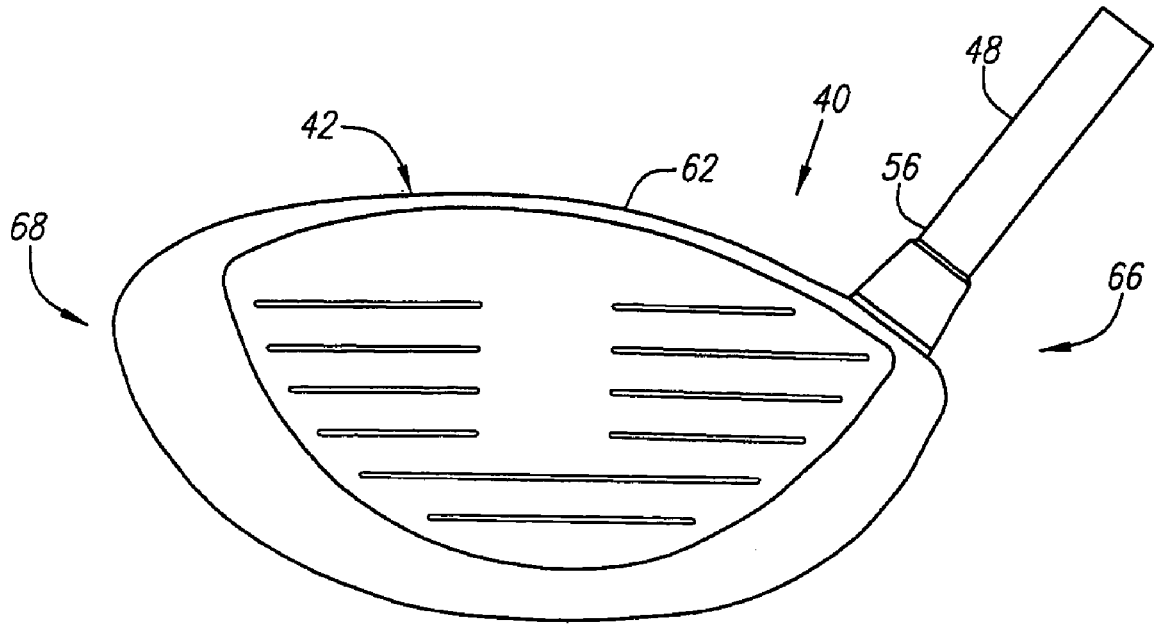
FIG. 4 is a front view of a golf club.
Figure 5:
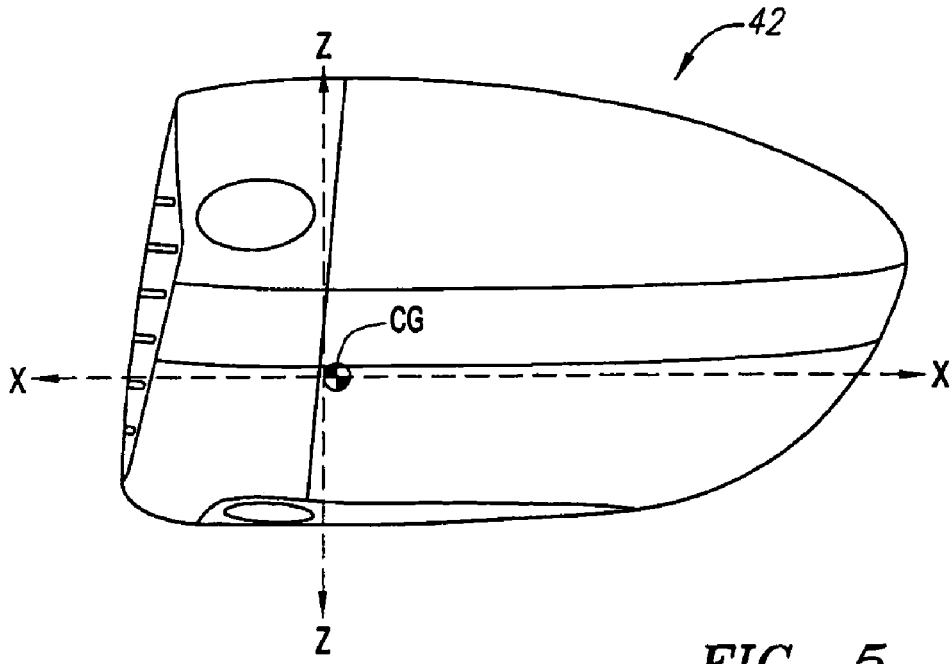
FIG. 5 is a heel side plan view of a golf club of the present invention illustrating the Z axis and X axis.
Figure 6:
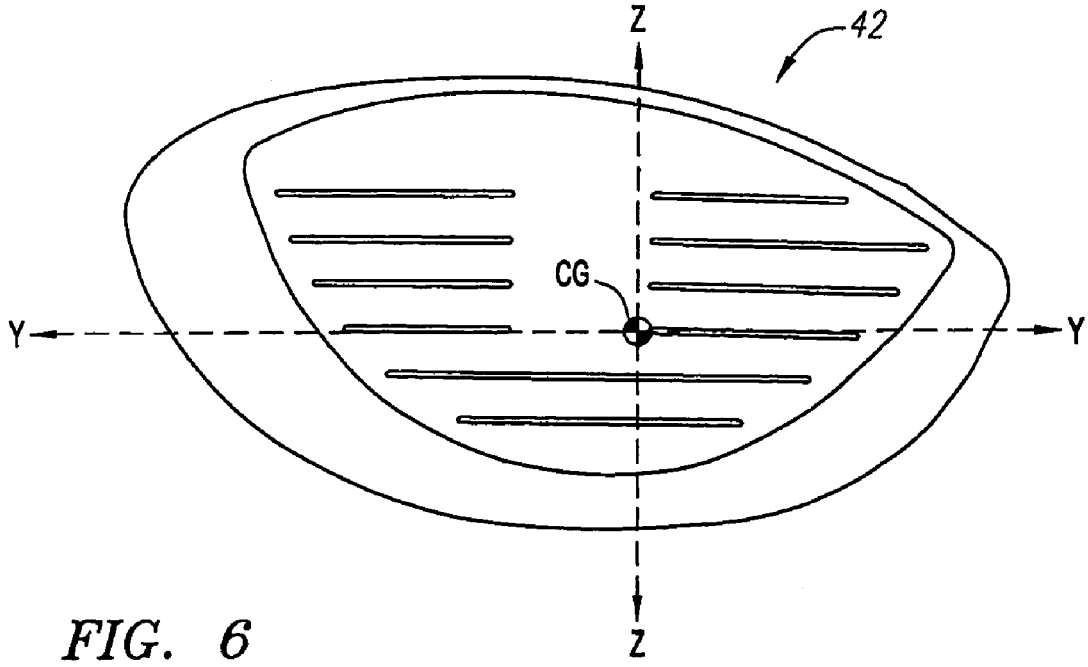
FIG. 6 is a front plan view of a golf club of the present invention illustrating the Z axis and Y axis.

As shown in FIG. 4, a golf club is generally designated 40. The golf club 40 has a golf club head 42 with a hollow interior, not shown. Engaging the club head 42 is a shaft 48 that has a grip 50, not shown, at a butt end and is inserted into a hosel 54, not shown, at a tip end 56. The club head 42 is preferably partitioned into a heel end 66 nearest the shaft 48 and a toe end 68 opposite the heel end 66. FIGS. 5 and 6 illustrate the moments of inertia axes, Ixx, Iyy and Izz, through the center of gravity of the golf club head 42. Numerous types of golf clubs may be used to fit a golfer using the method of the present invention. A preferred golf club head is disclosed in U.S. Pat. No. 6,739,983 for a Golf Club Head With Customizable Center of Gravity, which is mentioned above. An alternative golf club head is disclosed in U.S. Pat. No. 6,354,962, for a Golf Club Head With A Face Composed Of A Forged Material, which is hereby incorporated by reference in its entirety. Yet another alternative golf club head is disclosed in U.S. Pat. No. 6,508,978, for a Golf Club Head With A Weighting Member And Method Of Manufacturing The Same, which is hereby incorporated by reference in its entirety. Yet another alternative golf club head is disclosed in U.S. Pat. No. 6,440,008, for A Composite Golf Club Head And Method Of Manufacturing, which is hereby incorporated by reference in its entirety. Yet another alternative golf club head is disclosed in U.S. Pat. No. 6,648,773, for a Golf Club, which is hereby incorporated by reference in its entirety. Yet another alternative golf club head is disclosed in U.S. Pat. No. 6,440,008, for A Composite Golf Club Head And Method Of Manufacturing, which is hereby incorporated by reference in its entirety. Yet another alternative golf club head is disclosed in U.S. Pat. No. 6,719,643, for A Golf Club Head With A Face Insert, which is hereby incorporated by reference in its entirety.

FIG. 7 illustrates a table of optimized ball launch parameters for typical golf club speeds. These are the preferred ranges used in determining if the selected golf club is appropriate for the golfer. Column two is for the launch angle of the golf ball, which is measured by the launch monitor discussed above. Column three is for the backspin of the golf ball, which is measured by the launch monitor discussed above. Column four is for the side angle of the golf ball, which is measured by the launch monitor discussed above. Column five is for the sidespin of the golf ball, which is measured by the launch monitor discussed above. Column six is for the true spin of the golf ball, which is measured by the launch monitor discussed above.

If the golfer's ball striking characteristics for the selected golf club are in the optimum range, as set forth in the table in FIG. 7, then the fitting is complete. However, if the golfer's ball striking characteristics for the selected golf club are not in the optimum range, as set forth in the table in FIG. 7, then a second golf club is selected for the golfer. Preferably, a horizontal center of gravity shift will be made for every 300 rotations per minute (rpm) of side spin outside of the targeted range. Preferably, a vertical center of gravity shift will be made for every 300 rpm of backspin outside of the targeted range. The loft angle of the golf club will be adjusted for launch angle and the whole loft/half-loft will be adjusted to remedy a side angle outside of the target range.

Various methods and systems may be used for obtaining a golfer's ball striking characteristics without departing from the scope and spirit of the present invention. A preferred method and system is disclosed in U.S. Pat. No. 6,431,990 for a System And Method For Measuring A Golfer's Ball Striking Parameters, which is mentioned above. An alternative method and system is disclosed in U.S. Pat. No. 6,506,124 for a Method For Predicting A Golfer's Ball Striking Performance, which is hereby incorporated by reference in its entirety. An alternative method and system is disclosed in U.S. patent application Ser. No. 10/843,783, filed May 11, 2004, for a System And Method For Predicting A Golfer's Striking Performance, which is hereby incorporated by reference in its entirety. An alternative method and system is disclosed in U.S. patent application Ser. No. 10/843,048, filed May 10, 2004, for a System And Method For Measuring A Golfer's Ball Striking Performance, which is hereby incorporated by reference in its entirety. An alternative method and system is disclosed in U.S. patent application Ser. No. 10/843,782, filed May 11, 2004, for a Method For Determining A Golfer's Impact Properties During A Golf Swing, which is hereby incorporated by reference in its entirety.

Figure 8:
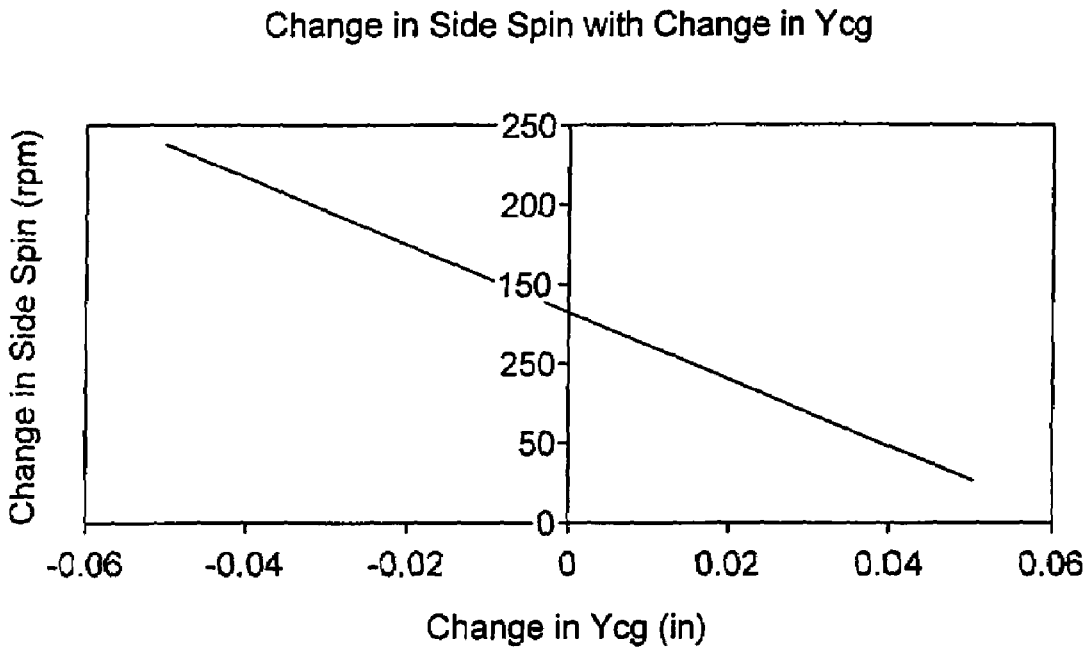
FIG. 8 is a graph of the change in side spin versus the change in the horizontal position (from heel to toe) of the center of gravity of the golf club head.
Figure 9:
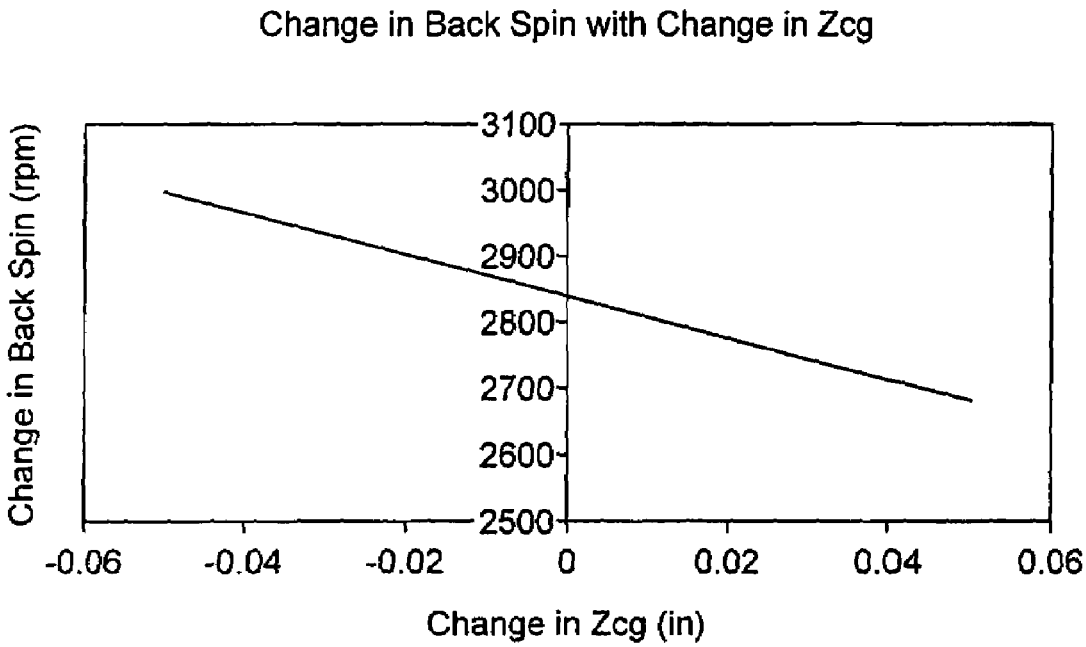
FIG. 9 is a graph of the change in back spin versus the change in the vertical position (from crown to sole) of the center of gravity of the golf club head.

FIGS. 8 and 9 illustrate the effect on side spin and back spin, respectively, by movement of the center of gravity of the golf club head 42. FIGS. 8 and 9 specifically illustrate movement of 50 grams of discretionary mass in a golf club head having a mass of 200 grams. To achieve a 0.050 inch movement of the Ycg or Zcg position of the center of gravity of the golf club head, a weight member having a mass of 50 grams is preferably moved 0.20 inch in any direction (Ycg or Zcg). To achieve a 0.050 inch movement of the Ycg or Zcg position of the center of gravity of the golf club head, two weight members, each having a mass of 25 grams, are preferably both moved 0.20 inch in any direction (Ycg or Zcg) or one is moved 0.40 inch in any direction. To achieve a 0.050 inch movement of the Ycg or Zcg position of the center of gravity of the golf club head, three weight members, each having a mass of 17 grams are preferably all moved 0.20 inch in any direction (Ycg or Zcg), two are moved 0.30 inch in any direction (Ycg or Zcg), or one is moved 0.60 inch in any direction (Ycg or Zcg). To achieve a 0.050 inch movement of the Ycg or Zcg position of the center of gravity of the golf club head, four weight members, each having a mass of 12.5 grams are preferably all moved 0.20 inch in any direction (Ycg or Zcg), three are moved 0.27 inch in any direction (Ycg or Zcg), two are moved 0.40 inch in any direction (Ycg or Zcg), or one is moved 0.80 inch in any direction (Ycg or Zcg). Those skilled in the pertinent art will recognize that other variations with more weight members of varying masses may be used to control the center of gravity of the golf club head without departing from the scope and spirit of the present invention.

A preferred golf club for fitting to a golfer is disclosed in the previously incorporated U.S. Pat. No. 6,739,983. By providing a face component and various, interchangeable aft-bodies, each of which has a different arrangement of weight members, similar style golf club heads with different center of gravity locations can be produced. The location of the center of gravity of the golf club head affects the spin characteristics of the golf club head. The choice a particular face component and aft-body combination will depend on the needs of the specific golfer. For example, a golf club with a tendency to provide a draw shot shape would be better suited for golfers who tend to hit a fade or slice. In addition, a golf club with a tendency to provide a higher ball trajectory would be better suited for golfers who tend to hit golf balls lower than desired.

In order to provide a golfer with a customized club, the golfer's swing and ball striking performance must be known or determined. One such method of predicting a golfer's ball striking performance is disclosed in U.S. Pat. No. 6,506,124, which is hereby incorporated by reference in its entirety. The optimal golf club head center of gravity location is then determined based on the golfer's performance, and the appropriate aft-body 61 is selected. The aft-body 61 is then attached to the face component 60 to provide a custom golf club head 42.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A method for fitting a golf club to a golfer based on the golfer's ball striking characteristics and the golfer's current golf club characteristics, the method comprising:

obtaining data for the inherent properties of the golfer's current golf club;

obtaining data for the golfer's typical playing characteristics;

inputting the data for golfer's typical playing characteristics and the data for the inherent properties of the golfer's current golf club into a golf club fitting algorithm, the golf club fitting algorithm comprising a matrix based on ball flight characteristics, ball flight distance and ball roll;

selecting a golf club as determined by the golf club fitting algorithm;

striking a plurality of golf balls with the selected golf club;

analyzing the golfer's ball striking characteristics with the selected golf club; and correlating a plurality of ball impact locations data with the center of gravity location of the selected golf club and analyzing the ball striking characteristics to determine if the selected golf club is optimized for the golfer.

2. The method according to claim 1 wherein the golfer's ball striking characteristics comprises swing speed of the golf club head, the golf ball speed after impact with the golf club head, the launch angle of the golf ball after impact with the golf club head, the back spin of the golf ball after impact with the golf club head, the side spin of the golf ball after impact with the golf club head, and the side angle of the golf ball after impact with the golf club head.

3. The method according to claim 2 wherein the ball impact locations are utilized to verify an optimum golf club head center of gravity position for the golfer.

4. The method according to claim 2 wherein the golf ball launch angle data is utilized to select the optimum golf club head loft angle for the golfer.

5. The method according to claim 1 wherein the selected golf club has a center of gravity position optimized for the golfer based on the fitting algorithm.

6. The method according claim 1 wherein the ball impact locations on the selected golf club are determined using a face tape applied to the face of the golf club head of the selected golf club.

7. The method according to claim 1 further comprising:

determining that the selected golf club is not optimized for the golfer;

selecting a second selected golf club for the golfer;

striking a plurality of golf balls with the second selected golf club;

analyzing the golfer's ball striking characteristics with the second selected golf club; and correlating a plurality of ball impact locations data with the center of gravity location of the second selected golf club and analyzing the ball striking characteristics to determine if the second selected golf club is optimized for the golfer.

8. The method according to claim 1 wherein the selected golf club is a driver.

* * * * *